US006347660B1

(12) United States Patent
Sikkenga et al.

(10) Patent No.: US 6,347,660 B1
(45) Date of Patent: Feb. 19, 2002

(54) MULTIPIECE CORE ASSEMBLY FOR CAST AIRFOIL

(75) Inventors: William E. Sikkenga, Twin Lake; Arthur W. Grumm, Montague, both of MI (US)

(73) Assignee: Howmet Research Corporation, Whitehall, MI (US)

( * ) Notice: Subject to any disclaimer, the term of this patent is extended or adjusted under 35 U.S.C. 154(b) by 0 days.

(21) Appl. No.: 09/339,292

(22) Filed: Jun. 24, 1999

Related U.S. Application Data

(63) Continuation-in-part of application No. 09/203,441, filed on Dec. 1, 1998, now Pat. No. 6,186,217.

(51) Int. Cl.[7] ..... B22D 33/04; B22C 9/10

(52) U.S. Cl. ..... 164/137; 164/369

(58) Field of Search ..... 164/137, 369

(56) References Cited

U.S. PATENT DOCUMENTS

| | | | | |
|---|---|---|---|---|
| 2,362,745 A | | 11/1944 | Davidson | |
| 3,029,485 A | | 4/1962 | McCormick | |
| 3,648,756 A | | 3/1972 | McLaren | 164/23 |
| 3,756,309 A | | 9/1973 | Nishiyama et al. | 164/369 |
| 3,927,710 A | | 12/1975 | Hayes et al. | |
| 4,252,175 A | | 2/1981 | Whipple | 164/9 |
| 4,328,854 A | | 5/1982 | Gartner et al. | 164/369 |
| 4,417,381 A | | 11/1983 | Higginbotham | |
| 4,596,281 A | | 6/1986 | Bishop | 164/32 |
| 4,874,031 A | | 10/1989 | Janney | 164/76.1 |
| 5,296,308 A | * | 3/1994 | Caccavale et al. | 164/361 |
| 5,337,805 A | | 8/1994 | Green et al. | 164/369 |
| 5,385,705 A | | 1/1995 | Malloy et al. | 264/219 |
| 5,498,132 A | | 3/1996 | Carozza et al. | 416/97 R |
| 5,735,335 A | | 4/1998 | Gilmore et al. | 164/516 |
| 6,186,217 B1 | | 2/2001 | Sikkenga et al. | 164/137 |

FOREIGN PATENT DOCUMENTS

| | | | | |
|---|---|---|---|---|
| DD | 248755 | * | 8/1987 | 164/369 |
| JP | 2-137644 | * | 5/1990 | 164/369 |
| JP | 3-18457 | * | 1/1991 | 164/137 |
| JP | 5-185181 | * | 7/1993 | 164/137 |
| JP | 6-234042 | * | 8/1994 | 164/137 |

* cited by examiner

*Primary Examiner*—Nam Nguyen
*Assistant Examiner*—I.-H. Lin

(57) ABSTRACT

A multi-wall ceramic core assembly and method of making same wherein a plurality of individual thin wall, arcuate (e.g. airfoil shaped) core elements are formed in respective master dies to have close tolerance mating locating features that substantially prevent penetration of molten metal between the interlocked features during casting, the individual core elements are fired on ceramic supports to have integral locating features, the prefired core elements are assembled together using the locator features of adjacent core elements, and the assembled core elements are held together using a fugitive material. The multi-wall ceramic core assembly so produced comprises the plurality of spaced apart thin wall, arcuate core elements and located by the mated close tolerance locating features.

11 Claims, 2 Drawing Sheets

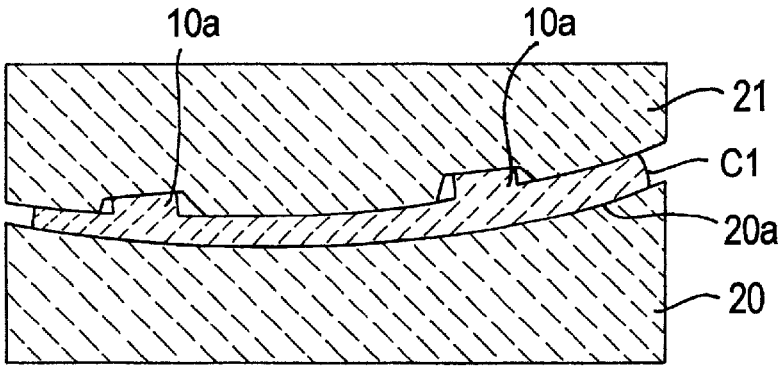
FIG. 2
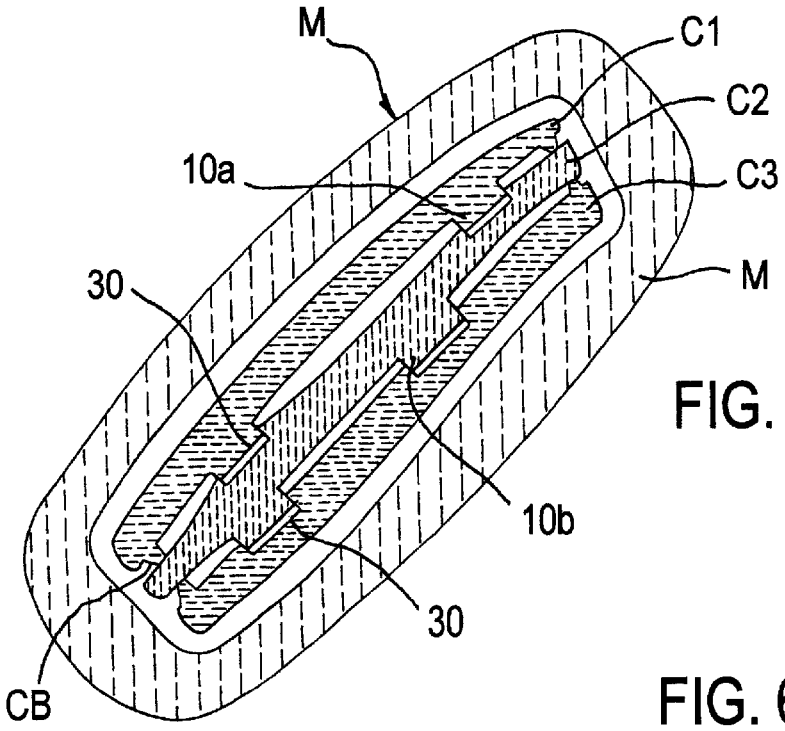
FIG. 5
FIG. 6
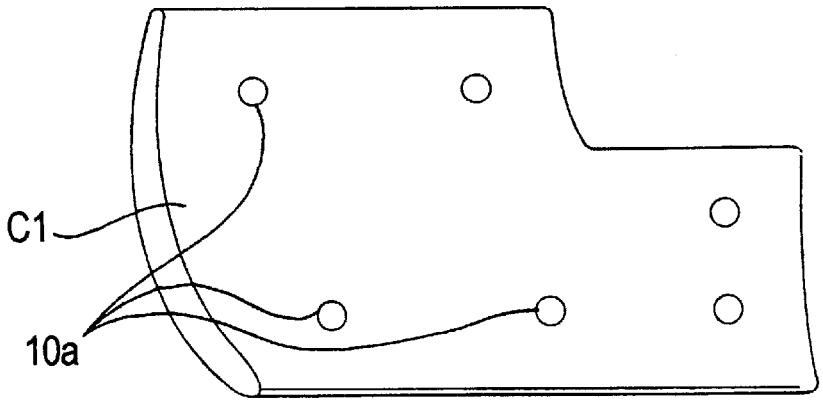

MULTIPIECE CORE ASSEMBLY FOR CAST AIRFOIL

This application is a continuation-in-part of application Ser. No. 09/203,441 filed Dec. 1, 1998 and now issued as U.S. Pat. No. 6,186,217.

FIELD OF THE INVENTION

The present invention relates to complex multi-piece ceramic core assemblies for casting superalloy airfoil castings, such as airfoils having multiple cast walls and complex channels for improved air cooling efficiency.

BACKGROUND OF THE INVENTION

Most manufacturers of gas turbine engines are evaluating advanced multi-walled, thin-walled turbine airfoils (i.e. turbine blade or vane) which include intricate air cooling channels to improve efficiency of airfoil internal cooling to permit greater engine thrust and provide satisfactory airfoil service life.

U.S. Pat. Nos. 5,295,530 and 5,545,003 describe advanced multi-walled, thin-walled turbine blade or vane designs which include intricate air cooling channels to this end.

In U.S. Pat. No. 5,295,530, a multi-wall core assembly is made by coating a first thin wall ceramic core with wax or plastic, a second similar ceramic core is positioned on the first coated ceramic core using temporary locating pins, holes are drilled through the ceramic cores, a locating rod is inserted into each drilled hole and then the second core then is coated with wax or plastic. This sequence is repeated as necessary to build up the multi-wall ceramic core assembly.

This core assembly procedure is quite complex, time consuming and costly as a result of use of the multiple connecting and other rods and drilled holes in the cores to receive the rods. in addition, this core assembly procedure can result in a loss of dimensional accuracy and repeatability of the core assemblies and thus airfoil castings produced using such core assemblies.

An object of the present invention is to provide a multi-wall ceramic core assembly and method of making same for use in casting advanced multi-walled, thin-walled turbine airfoils (e.g. turbine blade or vane castings) which can include complex air cooling channels to improve efficiency of airfoil internal cooling.

Another object of the present invention is to provide a multi-wall ceramic core assembly and method of making same for use in casting advanced multi-walled, thin-walled turbine airfoils wherein at least a portion of the multi-piece core assembly is formed in novel manner without ceramic adhesive which overcomes disadvantages of the previous core assembly techniques.

SUMMARY OF THE INVENTION

The present invention provides, in an illustrative embodiment, a multi-wall ceramic core assembly and method of making same wherein a plurality of individual thin wall, arcuate (e.g airfoil shaped) core elements are formed in respective master dies to have integral close tolerance mating locator features, the individual core elements are fired on ceramic supports, and the fired core elements are assembled together using the close tolerance mating features of adjacent core elements mating with one another in a manner to effect proper core element positioning and to substantially prevent penetration of molten metal between the mated features during casting. A fugitive material, such as molten wax, is applied at various locations of the core elements after assembly to hold them in position until a fugitive pattern followed by a ceramic shell mold are formed thereabout. The core assembly described above pursuant to the invention can comprise a subassembly of an aggregate core assembly used to produce complex air cooling passages in a gas turbine airfoil, such as a turbine blade or vane.

The multi-wall ceramic core assembly or portion thereof so produced comprises the plurality of spaced apart thin wall, arcuate (e.g airfoil shaped) core elements located relative to one another by the mating locator features in close tolerance fit.

The present invention is advantageous in that the ceramic core elements can be formed with the close tolerance mating locator features by conventional injection or transfer molding using appropriate ceramic compounds, in that firing of the core elements improves their dimensional integrity and permits their inspection prior to assembly to improve yield of acceptable ceramic core assemblies and reduces core assembly costs as a result, and in that high dimensional accuracy and repeatability of core assemblies is achievable without the need for ceramic adhesive between the core elements.

DESCRIPTION OF THE DRAWINGS

FIG. 2 is an sectional view of an individual core element on a ceramic setter support for core firing.

FIG. 5 is a sectional view showing the core assembly invested in a ceramic investment casting shell mold with wax pattern removed.

FIG. 6 is a sectional view of the individual core element showing an exemplary pattern of preformed locator features on the inner surface.

DESCRIPTION OF THE INVENTION

Referring to FIGS. 1–6, the present invention provides in the illustrative embodiment shown a multi-wall ceramic core assembly 10 and method of making same for use in casting a multi-walled, thin-walled airfoil (not shown) which includes a gas turbine engine turbine blade and vane. The core assembly 10 typically comprises a subassembly of an aggregate core assembly (not shown) that is used in casting gas turbine airfoils with complex internal air cooling passages and that includes at least one other core element or subassembly that defines other internal features of the casting and a conventional core print for embedding in a ceramic shell mold formed about the aggregate core assembly, although the core assembly pursuant to the invention can be used alone in other casting applications and not joined or otherwise united to other core elements or subassemblies. The turbine blade or vane can be formed by casting molten superalloy, such as a known nickel or cobalt base superalloy, into ceramic investment shell mold M in which the core assembly 10 is positioned as shown schematically in FIG. 5.

The molten superalloy can be directionally solidified as is well known in the mold M about the core 10 to produce a columnar grain or single crystal casting with the ceramic core assembly 10 therein. Alternately, the molten superalloy can be solidified in the mold M to produce an equiaxed grain casting as is well known. The core assembly 10 is removed by chemical leaching or other suitable techniques to leave the cast airfoil with internal passages at regions formerly occupied by the core elements Cl, C2, C3 as explained below.

Figure 1:
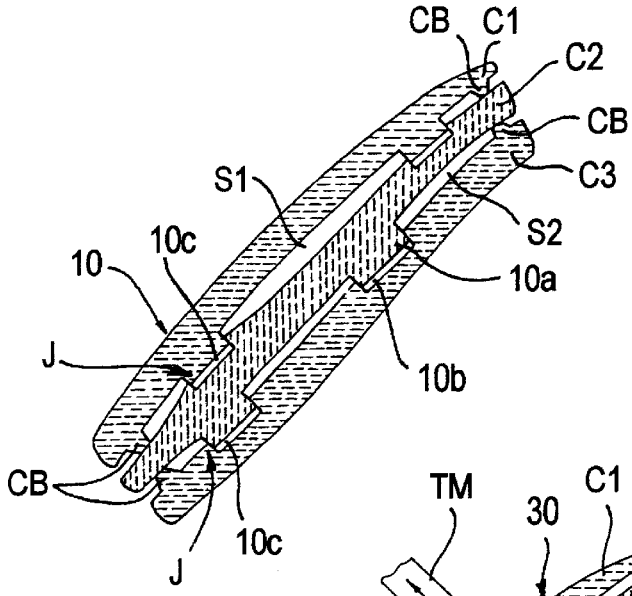
FIG. 1 is a sectional view of a multi-piece ceramic core assembly pursuant to an illustrative embodiment of the invention.

Referring to FIG. 1, an exemplary core assembly 10 of the invention comprises a plurality (3 shown) of individual thin wall, arcuate core elements C1, C2, C3 that have integral, preformed mating locator features comprising cylindrical male projections or posts 10*a* on core elements C1, C2 and complementary cylindrical female recesses or counterbores 10*b* on core element C2, C3 as shown. The posts 10*a* and counterbores 10*b* are not limited to cylindrical shapes and can comprise various other geometrical shape. The posts 10*a*are received in the recesses 10*b* as shown with a typical close tolerance clearance that prevents penetration of molten metal during casting and yet permits relative thermal expansion of the core elements. A close tolerance clearance between each post and mating recess of about 0.001 to about 0.003 inch at or per side (e.g. about 0.001 to 0.003 inch clearance on radius for a cylindrical post/recess) in FIG. 3, for example, is preferred in practicing the invention to substantially prevent penetration of molten metal, such as molten nickel or cobalt base superalloy, during casting (e.g. to eliminate or reduce molten metal penetration to an extent that only thin metal or alloy fins are formed in the clearance) and yet permit relative thermal expansion of the core elements made of commonly used ceramic core ceramics, such as silica based, alumina based, zircon based, zirconia based, or other suitable core ceramic materials and mixtures thereof known to those skilled in the art. The clearance between the end of a post 10*a* and the mating recess 10*b* is in the range of 0.001 to 0.010 inch as needed for dimensional control of lateral spacing of the core elements from one another. For purposes of illustration only, the clearance would be in the range of 0.001 to 0.002 inch for dimensional control of lateral spacing of the core elements from one another in the absence of other spacing control features such as the core bumpers CB referred to below.

The posts 10*a* and recesses 10*b* are arranged in complementary patterns on the core elements C1, C2, C3 in a manner that the posts 10*a* and recesses 10*b* mate together and are effective to mate the core elements in prescribed relationship to one another to form internal cast walls and internal cooling air passages in an airfoil to be cast about the core assembly 10 in the mold M, FIG. 5. An exemplary pattern of posts 10*a* on core element C1 is shown in FIG. 6.

Figure 3:
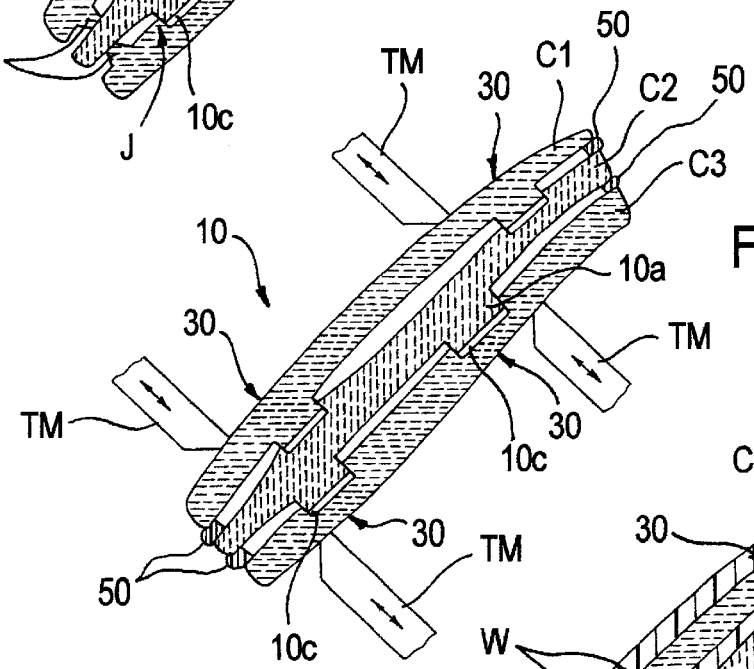
FIG. 3 is a sectional view of the core assembly with core elements positioned by close tolerance male/female locator features mating with one another and multiple wax bead applied to hold the core elements in position.
Figure 4:
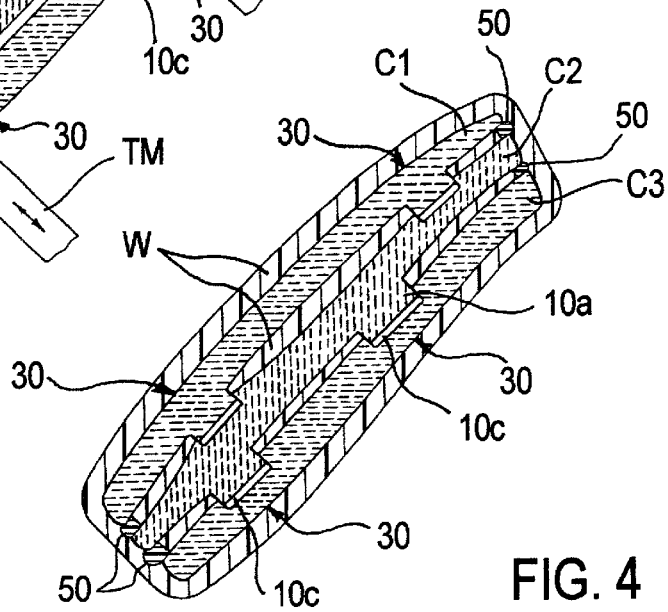
FIG. 4 is a sectional view showing the core assembly showing a wax pattern formed about the core elements.

After the core elements C1, C2,C3, are assembled with the locator features in mating relation, they are temporally held together by application of multiple, localized molten wax regions 50 at various locations to permit pattern injection molding about the core assembly followed by investing in a ceramic shell mold. Typically, the wax regions 50 comprise beads of conventional wax having suitable properties for use as adhesive applied at peripheral or end regions of the core assembly 10 as illustrated in FIG. 3, although the invention is not so limited since the wax can be applied at other locations of the core assembly as needed. In the ceramic shell mold, the core elements C1, C2, C3 are spaced apart to form desired spaces S1, S2 therebetween by integral bumpers CB molded on opposing core surfaces pursuant to U.S. Pat. No. 5,296,308, the teachings of which are incorporated herein to this end. The spaces S1, S2 ultimately will be filled with molten superalloy when superalloy is cast about the core assembly 10 in the shell mold M.

The individual thin wall, arcuate core elements C1, C2, C3 are formed in respective master dies (not shown) to have the arcuate configuration shown and the mating locator features 10*a*, 10*b* preformed integrally thereon. The core elements can be formed with the arcuate configuration and integral close tolerance locator features illustrated by transfer or injection molding wherein a ceramic compound or slurry, respectively, is introduced into a respective master die configured like respective core elements C1, C2, C3. The invention is not limited to this core forming technique and can be practiced as well using poured core molding, slip-cast molding or other techniques. That is, a master die will be provided for each core element C1, C2, C3 to form that core element with the appropriately positioned locator features 10*a* and /or 10*b*. U.S. Pat. No. 5,296,308 describes injection molding of ceramic cores with integral features and is incorporated herein by reference. Alternately, the core elements can be formed using poured core molding, slip-cast molding or other techniques.

In production of a core assembly 10 for casting a nickel or cobalt based superalloy airfoil, such as a gas turbine engine blade or vane, the core elements C1, C2, C3 will have a general airfoil cross-sectional profile with concave and convex sides and leading and trailing edges complementary to the airfoil to be cast as those skilled in the art will appreciate.

The ceramic core elements C1, C2, C3 can comprise silica based, alumina based, zircon based, zirconia based, or other suitable core ceramic materials and mixtures thereof known to those skilled in the art. The particular ceramic core material forms no part of the invention, suitable ceramic core materials being described in U.S. Pat. No. 5,394,932. The core material is chosen to be chemical leachable from the airfoil casting formed thereabout as described below.

After molding, the individual green (unfired) core elements are visually inspected on all sides prior to further processing in order that any defective core elements can be discarded and not used in manufacture of the core assembly 10. This capability to inspect the exterior surfaces of the individual core elements is advantageous to increase yield of acceptable core assemblies 10 and reduce core assembly cost.

Following removal from the respective master dies and inspection, the individual green core elements are fired at elevated temperature on respective ceramic setter supports 20 (one shown in FIG. 2 for purposes of illustration only) or other ceramic support, such as on alumina or other ceramic powder sand bed (known as a sagger). Each ceramic setter support 20 includes an upper support surface 20*a* configured to support the adjacent surface of the core element (e.g. core element C1 in FIG. 3) resting thereon during firing. The bottom surface of the ceramic setter support 20 is placed on conventional support furniture or sagger so that multiple core elements can be loaded into a conventional core firing furnace for firing using conventional core firing parameters dependent upon the particular ceramic material of the core element.

Following removal from the firing furnace, the fired core elements C1,C2, C3 are assembled together using the preformed close tolerance male/female locator features 10*a*, 10*b* of adjacent core elements C1, C2 and C2, C3 to interlock and effect proper core element positioning and spacing relative to one another in the fixture. The core elements can be manually assembled on a fixture or assembled by suitable robotic devices.

The assembled core elements C1, C2, C3 are temporarily adhered together in a fixture or template having template members TM movable to engage and position the core elements relative to one another using molten wax or other fugitive material applied at various core locations and solidified at those locations to provide temporary core element holding or adhesive means.

After the molten wax has solidified, the core assembly 10 is removed from the fixture or template by retracting the movable members M to allow the adhered core assembly to be further processed. Ceramic adhesive may be used to fill any joint lines where core elements have surfaces that mate or nest with one another, at a core print area, or at other surface areas on exterior core surfaces with the adhesive smoothed flush with the exterior core surface.

The multi-wall ceramic core assembly 10 so produced comprises the plurality of spaced apart thin wall, arcuate (airfoil shaped) core elements C1, C2, C3 located relative to one another by the close tolerance mating locator features 10*a*, 10*b* and held together temporarily by the localized solidified wax regions 50 applied to the core assembly as described above to this end.

The multi-wall ceramic core assembly 10 then is further processed to inject a fugitive pattern about the core assembly in conventional manner and form an investment shell mold thereabout for use in casting superalloy airfoils. In particular, expendable pattern wax, plastic or other material is introduced into the spaces S1, S2 and about the core assembly 10 to form a core/pattern assembly. Typically, the core assembly 10 is placed in a wax pattern die to this end and molten wax W is injected about the core assembly 10 and into spaces S1, S2 to form a desired multi-walled turbine blade or vane configuration, FIG. 4. The core/pattern assembly then is invested in ceramic mold material pursuant to the well known "lost wax" process by repeated dipping in ceramic slurry, draining excess slurry, and stuccoing with coarse grain ceramic stucco until a shell mold is built-up on the core/pattern assembly to a desired thickness. The shell mold then is fired at elevated temperature to develop mold strength for casting, and the pattern is selectively removed by thermal or chemical dissolution techniques, leaving the shell mold M having the core assembly 10 therein, FIG. 5.

Molten superalloy then is introduced into the mold M with the core assembly 10 therein using conventional casting techniques without substantial penetration of the molten metal between the mating locator features 10*a*, 10*b* by virtue of their close tolerance relation. The molten superalloy can be directionally solidified in the mold M about the core assembly 10 to form a columnar grain or single crystal airfoil casting. Alternately, the molten superalloy can be solidified to produce an equiaxed grain airfoil casting. The mold M is removed from the solidified casting using a mechanical knock-out operation followed by one or more known chemical leaching or mechanical grit blasting techniques. The core assembly 10 is selectively removed from the solidified airfoil casting by chemical leaching or other conventional core removal techniques. The spaces previously occupied by the core elements C1, C2, C3 comprise internal cooling air passages in the airfoil casting, while the superalloy in the spaces S1, S2 forms internal walls of the airfoil separating the cooling air passages.

The present invention is advantageous in that the ceramic core elements C1, C2, C3 can be formed with the close tolerance mating locator features 10*a*, 10*b* by conventional injection or other molding techniques using appropriate ceramic compounds/slurries and in that firing of the core elements improves their dimensional integrity and permits their inspection prior to assembly to improve yield of acceptable ceramic core assemblies and reduces core assembly costs as a result. Moreover, ceramic adhesive is not needed to adhere the core elements to one another.

It will be apparent to those skilled in the art that various modifications and variations can be made in the embodiments of the present invention described above without departing from the spirit and scope of the invention as set forth in the appended claims.

We claim:

1. A method of making a multi-wall ceramic core assembly for casting an airfoil with internal cooling passages, comprising forming a plurality of individual arcuate core elements comprising ceramic material and configured to form the cooling passages in the airfoil, firing the core elements, and assembling the fired core elements by mating male and female locator features disposed between adjacent core elements and integral with said adjacent core elements.

2. The method of claim 1 including applying a fugitive material to localized regions of the assembled core elements to temporarily hold the assembled core elements in position before a fugitive pattern is formed on said assembled core elements.

3. The method of claim 2 wherein the fugitive material is applied to peripheral locations of the core assembly.

4. The method of claim 1 wherein the core elements are formed by molding.

5. The method of claim 1 wherein the arcuate core elements form an airfoil profile for use in casting a turbine airfoil.

6. The method of claim 1 wherein the fired core elements are assembled in a fixture with their locator features mated with a clearance of about 0.001 to about 0.003 inch at each side and with a fugitive material applied at multiple localized regions of the assembled core elements to hold the assembled core elements in position before a fugitive pattern is formed on said assembled core elements.

7. A ceramic core assembly for casting an airfoil with internal cooling passages, comprising a plurality of spaced apart arcuate, fired ceramic core elements configured to form the cooling passages in the airfoil and located relative to one another by mated male and female locator features disposed between adjacent core elements and integral therewith.

8. The core assembly of claim 7 wherein the arcuate core elements form an airfoil profile for use in casting a turbine airfoil.

9. A method of making an airfoil casting having multiple walls defining cooling passages therebetween, comprising positioning the core assembly of claim 7 in a ceramic mold and introducing molten metallic material into the mold about the core assembly without penetration of the molten matallic material between the mated male and female locator features by virtue of close tolerance fit therebetween.

10. The method of claim 9 wherein the molten metallic material is solidified in the mold to form an equiaxed casting or a directionally solidified casting.

11. The core assembly of claim 7 including fugitive material applied at multiple localized regions of the core assembly to hold the core elements together.

* * * * *